US006025806A

United States Patent [19]

Deininger et al.

[11] Patent Number: 6,025,806

[45] Date of Patent: Feb. 15, 2000

[54] CONTACTING SYSTEM OF A FLAT ANTENNA CONDUCTOR STRUCTURE

[75] Inventors: Juergen Deininger, Stuttgart; Norbert Lotterer, Eningen, both of Germany

[73] Assignee: DaimlerChrysler AG, Stuttgart, Germany

[21] Appl. No.: 08/801,864

[22] Filed: Feb. 18, 1997

[30] Foreign Application Priority Data

Feb. 17, 1996 [DE] Germany ..... 196 05 999

[51] Int. Cl.[7] ..... H01Q 1/32; H01Q 1/50

[52] U.S. Cl. ..... 343/713; 343/906

[58] Field of Search ..... 343/711, 712, 343/713, 906; H01Q 1/36, 1/32, 1/50

[56] References Cited

U.S. PATENT DOCUMENTS 5,600,333 2/1997 Justice et al. ..... 343/713

FOREIGN PATENT DOCUMENTS 2 649 650 1/1991 France .
35 23 228 10/1986 Germany .
36 04 437 8/1987 Germany .
41 25 999 10/1992 Germany .
42 32 746 3/1994 Germany .

*Primary Examiner*—Michael C. Wimer
*Attorney, Agent, or Firm*—Evenson, McKeown, Edwards & Lenahan, PLLC

[57] ABSTRACT

A contacting system of a flat antenna conductor structure is provided which is integrated in a vehicle installation part, particularly a vehicle window. First contacting devices are provided which are arranged on the vehicle installation part and are connected with the antenna conductor structure. Second contacting devices are provided which are arranged on the vehicle body side on at least one contact base. The contacting of the first contacting device via the corresponding second contacting device takes place by a relative movement between the vehicle installation part and the contact base during the installation. At least one electric connection line, at least one signal processing circuit and at least one carrier are provided. At least the contact base is an integral component of the carrier. The at least one electric connection line connects the respective second contacting device with the corresponding signal processing circuit. For the defined, impedance-adapting line routing, the at least one electric connection line is arranged in a defined manner along its whole length on the corresponding carrier.

28 Claims, 5 Drawing Sheets

SIGNAL PROCESSOR
2
1
7
5
6
4
3.2
3
3.1

IIb
4
1
3.1
10
IIb 1
8.1
9.1
8

IId, IIe
4
1
3
3.1
IId, IIe 1
8.1
3
9.1
8

1
8.1
3
8

IIg
4
1
3
3.1
IIg 1
3
8

CONTACTING SYSTEM OF A FLAT ANTENNA CONDUCTOR STRUCTURE

BACKGROUND AND SUMMARY OF THE INVENTION

This application claims the priority of German Application No. 196 05 999.2, the disclosure of which is expressly incorporated by reference herein.

The invention relates to the contacting system for a flat antenna conductor structure and, more particularly, to a contacting system for a flat antenna conductor structure which is integrated in a vehicle installation part, particularly a vehicle window, having at least one first contacting device which is arranged on the vehicle installation part and is connected with the antenna conductor structure, and at least one contact base with at least one second contacting device which is provided on the vehicle body side. The contacting of the respective first contacting device by means of the corresponding second contacting device takes place during a relative movement between the vehicle installation part and the contact base occurring during the installation.

A contacting system of the above-mentioned type is known from German Patent document DE 36 04 437, wherein an electric conductor of a motor vehicle window contacts a connection line extending in the vehicle. The contacting system of the above-mentioned type comprises a first contacting device which is arranged on the motor vehicle window and is connected with a line structure. In addition, a contact base is provided on the vehicle body side which has at least one second contacting device. The contacting of the respective first contacting device by means of the corresponding second contacting device takes place in the course of the installation during a relative movement between the installation part of the vehicle and the contact base.

German Patent document DE 35 23 228 C1 also describes a contacting system of an electric conductor of a motor vehicle window with a connection line extending in the motor vehicle. In this case, the contacting takes place by a relative movement during the installation.

In the case of the objects of the above known systems, it is considered to be disadvantageous that, because of the undefined position of the electric connection lines, the tolerance zone of the antenna impedance is enlarged. This results in a more serious impedance.

From German Patent document DE 42 32 746 C2, a contacting system of a flat antenna conductor structure is known which consists of a contact element and a contact point arranged on the antenna conductor structure. The contact element is formed of a metal strip having a connection lug. The metal strip is embedded in a flat carrier made of an electrically insulating plastic material. In this case, the connection lug is exposed and the metal strip is connected inside the carrier with an electric connection line. The electric connection line is led out of the carrier and is equipped at its free end for the connection to a sleeve or to a plug. The connection lug is connected in an electrically conducting manner with the contact point, particularly by means of soldering or spot welding.

In this case, a disadvantage is that an additional operation is required for contacting the connection lug by means of the contact point. In addition, because of the undefined position of the electric connection lines, the tolerance zone of the antenna impedance is enlarged and will result in a more serious mismatch.

From German Patent document DE 41 25 999 C1, a contact element is known for providing a resilient contact by means of two contact points which are mounted on the interior pane sides of a double glass pane. In this case, the contact element may have different geometrical configurations.

However, German Patent document DE 41 25 999 C1 does not disclose a solution for the problem of contacting a flat antenna conductor structure by means of an electric connection line, and the line routing, in order to transmit an antenna signal from a flat antenna conductor structure to a signal processing circuit.

There is therefore needed a contacting system of a flat antenna conductor structure of the above-mentioned type such that a simplified installation is possible, and the electric connection from an antenna conductor structure to a pertaining signal processing circuit is implemented in an impedance-matching construction method.

According to the invention, these needs are met by a contacting system for a flat antenna conductor structure which is integrated in a vehicle installation part, particularly a vehicle window, having at least one first contacting device which is arranged on the vehicle installation part and is connected with the antenna conductor structure, and at least one contact base with at least one second contacting device which is provided on the vehicle body side. The contacting of the respective first contacting device by means of the corresponding second contacting device takes place during a relative movement between the vehicle installation part and the contact base occurring during the installation. At least one electric connection line, at least one signal processing circuit and at least one carrier are provided. At least the contact base is an integral component of the carrier. The at least one electric connection line connects the respective second contacting device with the corresponding signal processing circuit. For the defined impedance-adapting line routing, the at least one electric connection line is arranged in a defined manner along its whole length on the corresponding carrier.

According to the invention, an electric connection is established between a flat antenna conductor structure, which is integrated in an installation part of the vehicle, particularly in a vehicle window, and a pertaining electric signal processing circuit by the contacting of at least one first contacting device, which is arranged on the vehicle installation part and is connected with the antenna conductor structure, by means of at least one corresponding second contacting device which, on the vehicle body side, is arranged on a contact base and is connected with an electric connection line. By means of the arrangement of the second contacting device on the contact base, a defined installed position is achieved. In this case, the contacting takes place by a relative movement between the vehicle installation part and the contact base during the installation. In this case, the relative movement is carried out, on the one hand, when the contact base is already installed, by means of the vehicle installation part, for example, by a fitting-on, and, on the other hand, when the vehicle installation part is already installed, by means of the contact base, for example, by a plugging-on.

In the simplest embodiment, the electric signal processing circuit is constructed as a socket.

According to an advantageous further development of the invention, the first contacting device is constructed as a contact surface and is part of the antenna conductor structure. The second contacting device is constructed as a spring element and is arranged on the contact base. In this case, an electric connection between the second contacting device and the signal processing circuit is established via the electric connection line which is connected with the second contacting device, for example, by soldering or spot welding.

In this embodiment of the invention, it is almost impossible to damage the first contacting device during transportation of the installation parts of the vehicle.

However, in principle, other embodiments are also possible. Thus, for example, the first contacting device can be constructed as a spring element and the second contacting device can be constructed as a contact surface. Alternatively, both contacting devices can be constructed as spring elements in order to avoid contact problems and to compensate for manufacturing tolerances.

In the present invention, the electric connection line is arranged on a carrier. This results in a defined spatial position and a predetermined length for the electric connection line, whereby the tolerance zone of the impedance is reduced and a larger distance can be implemented between the signal processing circuit and the flat antenna conductor structure. The carrier, which is connected with the housing of the signal processing circuit, is formed of the contact base and a contact arm.

Different embodiments are contemplated within the scope of the invention. Thus, the invention can also be used for contacting flat antenna conductor structures which are integrated in other installation parts of the vehicle, such as lights, plastic parts or other subassemblies.

Furthermore, the carrier can be a fixed component of the housing of the signal processing circuit and can simultaneously be used for fastening the housing. As required, several carriers can be used. In addition, the contact arm may be molded to the contact base so that the carrier is constructed as a compact component.

For avoiding adhesive contact, a protective strip, which can simultaneously be used as a spacing buffer, can be molded to the contact base.

The electric connection line can be constructed, for example, as a stranded wire, a coaxial cable, a sheet metal strip, strip conductors embedded in foil, or as a flexible conduction band.

For the Z-adaptation (impedance-adaptation) and the Z-transformation (impedance-transformation), the construction of the electric connection line as a strip line is particularly advantageous. In this case, the substrate of the strip line can be formed by the carrier, or the carrier can be used only for fastening and routing the electric connection line.

In addition, it is possible to construct the contact arm as a UHF antenna or higher-frequency antenna without the requirement of an antenna line structure on a vehicle installation part.

In another advantageous embodiment of the present invention, the electric connection line and the electric signal processing circuit are arranged on the carrier in a defined manner. In this case, several electric connection lines for several antenna conductor structures can be arranged on a carrier, in which case the electric signal processing circuits for the different antenna conductor structures can be combined in an electric signal processing circuit. In this embodiment, the carrier is arranged inside the housing of the signal processing circuit. In the housing of the signal processing circuit, passage openings are provided through which the second contacting devices can be contacted by the first contacting devices on the vehicle during the installation. In this embodiment, the electric signal processing circuit can be arranged in the direct proximity of the antenna conductor structure. The spring elements, by which the electric connection is established between the antenna conductor structures and the corresponding electric connection lines, can be constructed as electrically conducting elastomers. By the use of electrically conducting elastomers, microfriction occurring between the first and the second contacting devices is almost avoided, said microfriction occurring as a result of movements between the vehicle installation part and the vehicle body during the vehicle operation. Particularly in the case of amplitude-modulated signals, the microfriction results in excessive signal interferences. The described embodiment is particularly suitable for contacting several different antenna conductor structures integrated in a vehicle installation part.

Other objects, advantages and novel features of the present invention will become apparent from the following detailed description of the invention when considered in conjunction with the accompanying drawings.

DETAILED DESCRIPTION OF THE DRAWINGS

Figure 1:
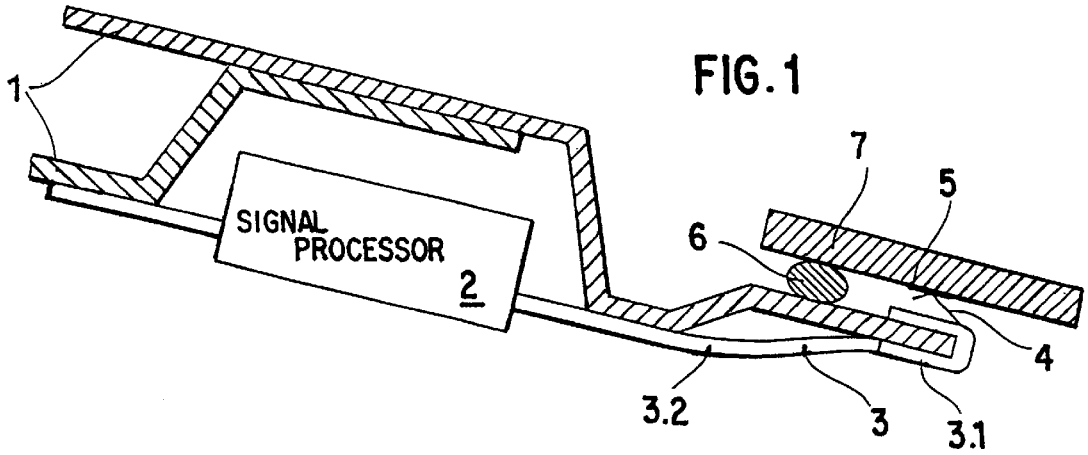
FIG. 1 is a schematic representation of an embodiment of the invention.

As illustrated in FIG. 1, a flat antenna conductor structure contact comprises a first contacting device 5, which is constructed as a contact surface and is mounted on a vehicle installation part 7, and a second contacting device 4 which is constructed as a spring element and is fastened on a contact base 3.1. A contact arm 3.2 is molded or fastened to the contact base 3.1. The contact base 3.1 and the contact arm 3.2 form an electrically non-conductive carrier 3 which may be constructed as a part of a housing 2 for a signal processing circuit, or may be fastened to the housing 2. The carrier 3 and the housing 2 are connected with the vehicle body 1. An adhesive bead 6 for fastening the vehicle installation part 7 is inserted between the vehicle installation part 7 and the vehicle body 1.

Figure 2A:
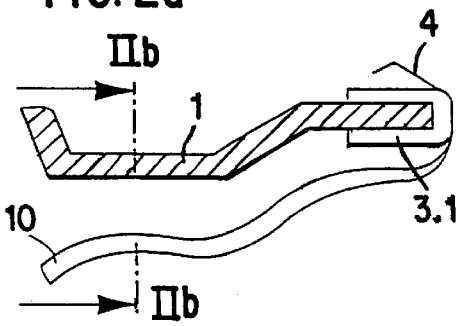
FIGS. 2*a*, 2*c* and 2*f* are schematic representations of different possible line routings.
Figure 2B:
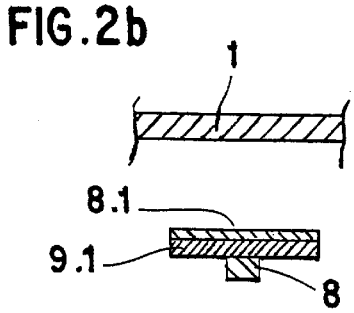
FIGS. 2*b*, 2*d*, 2*e* and 2*g* are sectional views with respect to different embodiments according to FIGS. 2*a*, 2*c* and 2*f;*
Figure 2C:
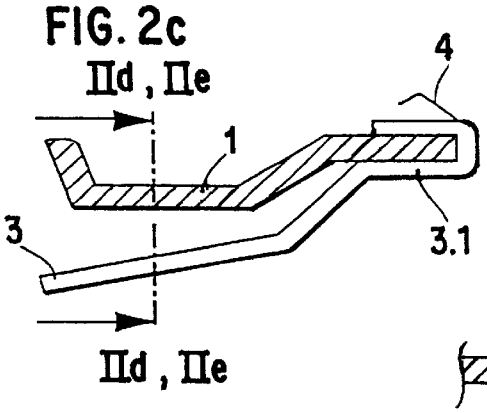
Figure 2D:
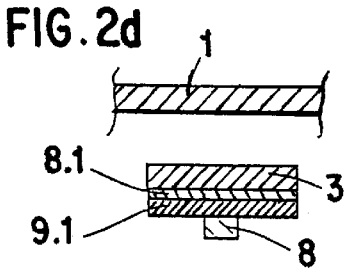
Figure 2E:
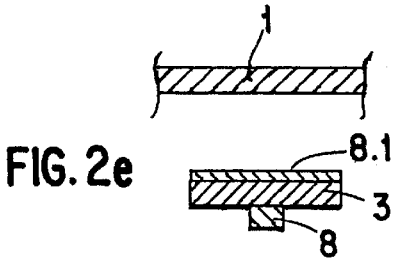
Figure 2F:
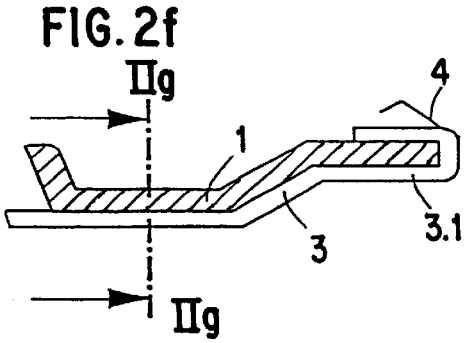

FIGS. 2*a*, 2*c* and 2*f* show different possible line routings via the carrier 3, in which case the electric connection line is illustrated only in the corresponding sectional views of FIGS. 2*b*, 2*d*, 2*e* and 2*g*.

FIG. 2*a* shows an embodiment in which the electric connection line is constructed as a flexible conductor strip 10. FIG. 2*b* is a sectional view along intersection line II*b* in FIG. 2*a*, in which case the flexible conductor strip 10 is constructed as a strip line. The strip line comprises a grounding conductor 8.1, an antenna conductor 8 and a separating substrate 9.1 having a specific relative permittivity $\epsilon_r$. Together with the contact base 3.1, the separating substrate 9.1 takes over the function of the carrier 3. The antenna conductor 8 connects the second contacting device 4 with a signal processing circuit which is not shown. The grounding conductor 8.1 is connected with a grounding connection of the signal processing circuit and has an open end on the contact base 3.1. In the case of another embodiment, which is not shown, the grounding conductor 8.1 does not end open at the contact base 3.1, but rather is connected with an additional second contacting device which, during the installation, establishes an electric contact with an additional corresponding first contacting device.

FIG. 2*c* shows an embodiment having a dimensionally stable carrier 3.

FIG. 2*d* is a first sectional view along the intersection line II*d* in FIG. 2*c* in which the carrier 3 is used only for the fastening guiding of the electric connection line which is constructed analogously to FIG. 2*b* as a strip line. In this case, the electric connection line can be constructed as a self-adhesive flexible line band 10 according to FIG. 2*a*.

FIG. 2*e* is another sectional view along intersection line II*e* in FIG. 2*c* in which the substrate of the strip line is formed by the dimensionally stable carrier 3. On the underside of the carrier 3 (facing the vehicle body), the grounding conductor 8.1 is mounted, and on the top side, the antenna conductor 8 is mounted.

FIG. 2*f* illustrates an embodiment in which the carrier 3 is adapted to the contour of the vehicle body 1 and may be constructed to be self adhesive.

Figure 2G:
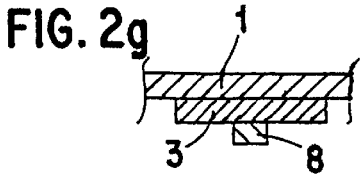

FIG. 2*g* is a sectional view along intersection line II*g* in FIG. 2*f*. In this case, the strip line technique is implemented in that the vehicle body 1 is used as a grounding conductor and the carrier 3 is used as a separating substrate on whose top side the antenna conductor 8 is mounted.

As another embodiment which is not shown, the flexible conductor band 10 may be constructed to be self-adhesive and, according to FIG. 2*f*, may be arranged on the vehicle body 1.

Figure 3:
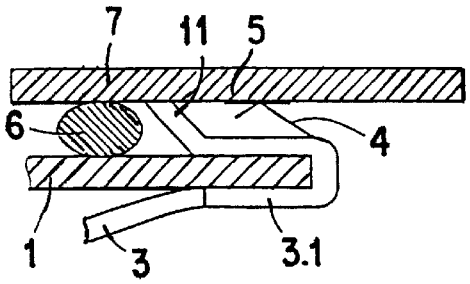
FIG. 3 is a schematic representation of the contact base having a protective strip according to the invention.

FIG. 3 shows an embodiment of the contact base 3.1 in the case of which a protective strip 11 is molded to the contact base 3.1. The protective strip 11 has the purpose of preventing contact between the contacting devices 4, 5 with the adhesive bead 6. At the same time, the protective strip 11 can be constructed as a spacing buffer between the vehicle body 1 and the vehicle installation part 7. As a result of the construction of the protective strip 11 as a spacing buffer, a defined distance is obtained between the contact base 3.1 and the vehicle installation part 7. Thus, a defined contact force is obtained between the two contacting devices 4, 5. The spacing buffer may be constructed with or without any compensation.

FIGS. 4*a* to 4*j* show different embodiments of the contacting devices 4, 5.

In this case, FIGS. 4*a* to 4*g* show different embodiments of the second contacting device 4 formed of a sheet metal part which, in the case of the illustrated embodiments, can be clipped onto the contact base 3.1. Naturally, other detachable, but also undetachable, manners of fastening can be selected. Thus, the second contacting device 4 could, for example, be screwed or riveted or glued to the contact base 3.1. In this case, the actual electric contact with the first contacting device 5 is established by means of a spring element 4.1. FIGS. 4*a* to 4*g* specifically show different embodiments of the spring element 4.1.

Figure 4A:
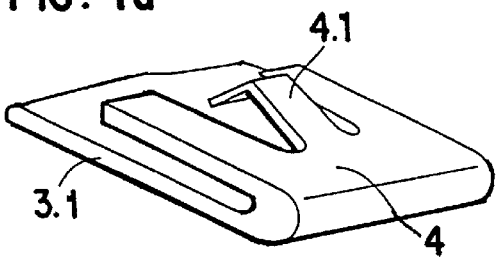
FIGS. 4*a* to 4*j* are schematic representations of different embodiments of the contacting devices.
Figure 4B:
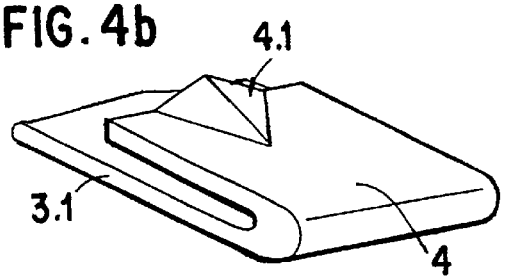
Figure 4C:
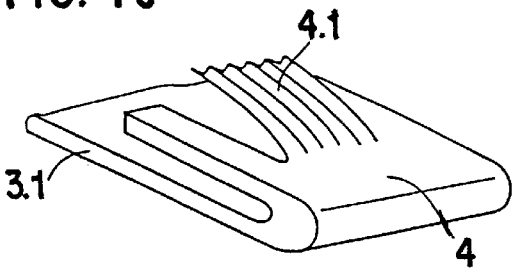
Figure 4D:
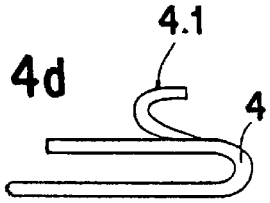
Figure 4E:
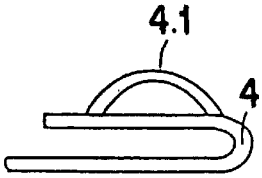
Figure 4F:
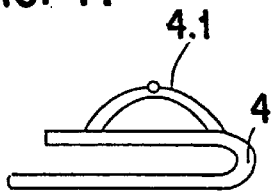
Figure 4G:
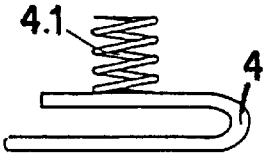
Figure 4H:
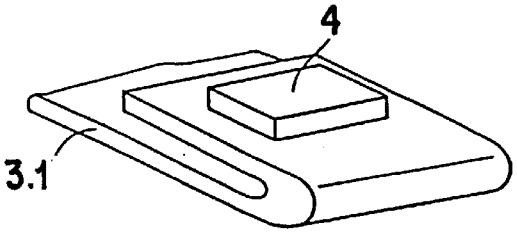

In addition, FIG. 4*h* shows an embodiment of the second contacting device 4 as an elastomer material or thermoplastic material which is constructed at least on the surface in an electrically conductive manner and is arranged on the contact base 3.1.

Figure 4I:
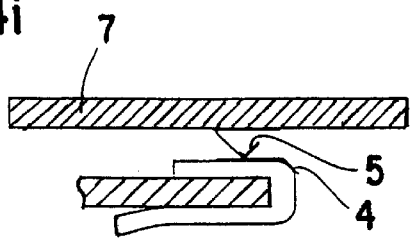

FIG. 4*i* shows an embodiment in which the first contacting device 5 is constructed as a spring element and the second contacting device 4 is constructed as a contact surface.

Figure 4J:
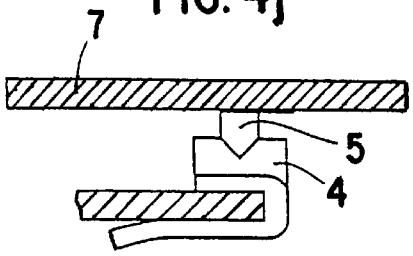

FIG. 4*j* shows an embodiment in which both contacting devices 4, 5 are spring elements which are constructed as an elastomer or thermoplastic material with at least one electrically conductive surface.

Figure 5:
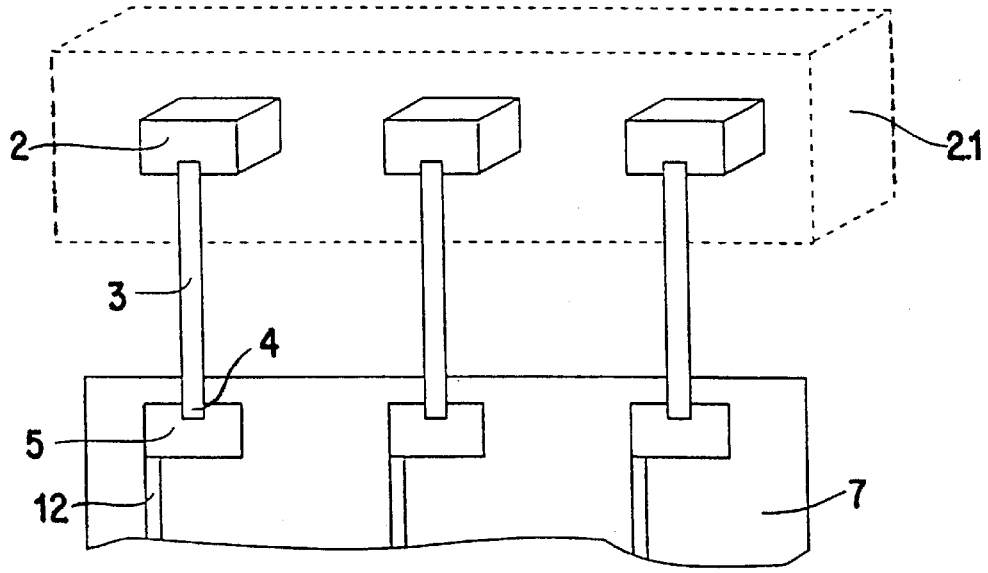
FIG. 5 is a schematic representation of the invention when several antennas are used on a vehicle installation part.

FIG. 5 shows an embodiment of the invention in which different antenna systems are used for different applications, for example, a combination of AM/FM antennas, diversity (signal reception by means of several antennas; therefore selection possibility as a function of the signal quality), radio, TV, GPS (Global Positioning System), DAS (Digital Audio Broadcasting), additional services (such as opening the garage door), GSM (Global System Mobile Communication) and telephone.

In each case, an antenna system includes an antenna 12, which is part of the antenna conductor structure and is only outlined in the drawing, and a first contacting device 5 which are both arranged on a vehicle installation part 7. The system further includes a carrier 3 with electric connection lines and with a second contacting device 4, and a signal processing circuit housed in a housing 2. In this case, the housing 2.1, which is indicated by a broken line, illustrates the possibility of housing all signal processing circuits in a common housing 2.1.

Figure 6:
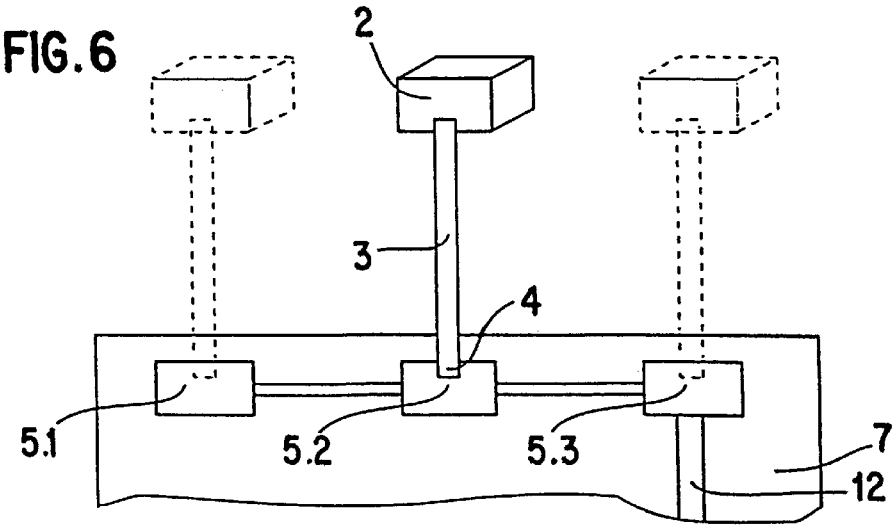
FIG. 6 is a schematic representation of the invention for an antenna having several contacting possibilities.

FIG. 6 shows the use of several first contacting devices 5.1 to 5.3 for an antenna 12. As a result, an alternative contacting, as a function of the positioning of the housing 2 of a signal processing circuit with the pertaining carrier 3, becomes possible for the purpose of a frequency adaptation. The broken lines show the alternative positioning possibilities.

Figure 7A:
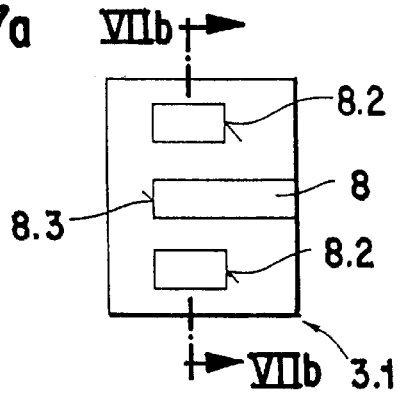
FIGS. 7*a* to 7*d* are schematic representations of different possible line routings on the contact base.
Figure 7B:
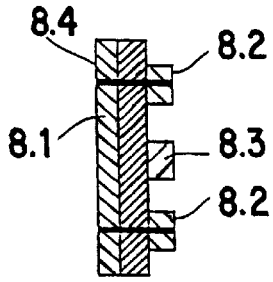

FIG. 7*a* and its sectional view 7*b* taken along the intersection line VII*b* in FIG. 7*a* show the construction of the grounding contact 8.2 for the grounding line 8.1 when the grounding line 8.1 is arranged on the underside of the carrier 3 or of the contact base 3.1. As illustrated in FIGS. 7*a* and 7*b*, the grounding line 8.1 on the underside of the contact base 3.1 is connected in an electrically conductive manner by a throughplating via hole 8.4 with the grounding contact 8.2 on the top side of the contact base 3.1. In this case, the section of the antenna conductor 8 which is arranged on the contact base 3.1 is called the antenna conductor contact 8.3.

Figure 7C:
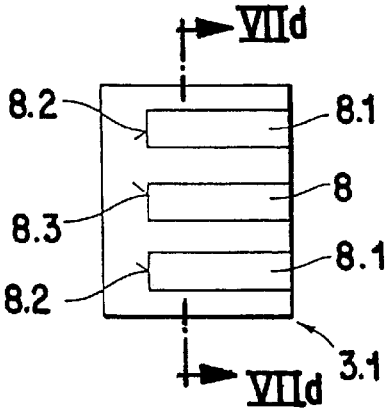
Figure 7D:
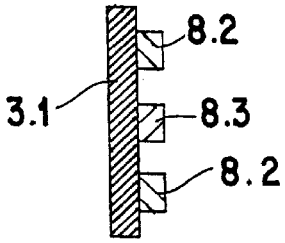

FIG. 7*c* and its sectional view 7*d* taken along the intersection line VII*d* in FIG. 7*c* show an embodiment of the invention in which an antenna conductor 8 and two grounding conductors 8.1 are arranged as coplanar lines side-by-side on the top side of the carrier 3 or of the contact base 3.1. In this case, the sections of the grounding conductor 8.1 which are arranged on the contact base 3.1 are called grounding contacts 8.2 and the section of the antenna conductor 8 which is arranged on the contact base 3.1 is called an antenna conductor contact 8.3.

Figure 7E:
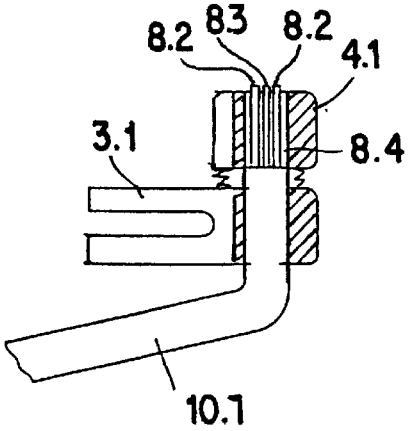
FIGS. 7*e* to 7*g* are schematic representations of the second contacting device when a coaxial cable is used as the electric connection line.
Figure 7F:
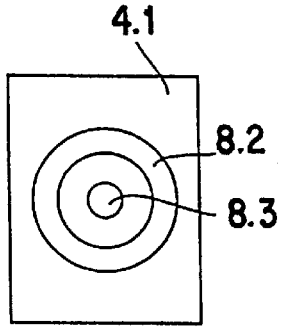
Figure 7G:
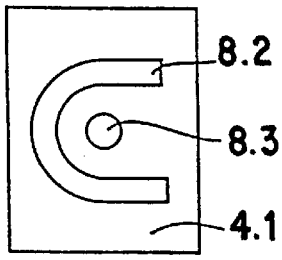

FIGS. 7*e* to 7*g* illustrate a construction of the contact base 3.1 having a spring element 4.1 with corresponding contacts for using a coaxial cable 10.1 as an electric connection line. In this case, FIG. 7*e* shows the contact base 3.1 and the spring element 4.1 with a throughplating 8.4 for the grounding conductor and the antenna conductor of the coaxial cable 10.1. By means of the throughplating 8.4, on the one hand, the grounding contact 8.2 on the top side of the spring element 4.1 is connected in an electrically conductive manner with the grounding conductor of the coaxial cable 10.1 and, on the other hand, the antenna conductor contact 8.3 is connected in an electrically conductive manner with the antenna conductor of the coaxial cable 10.1. FIGS. 7*f* and 7*g* are top views of the spring element 4.1, in each case illustrating an embodiment of the grounding contact 8.2 and the antenna conductor contact 8.3 on the top side of the spring element 4.1.

The grounding contacts 8.2 and antenna conductor contacts 8.3 mentioned in FIGS. 7*a* to 7*g* are each part of the second contacting device and may be constructed as contact surfaces or as elastic spring elements, for example, as elastomers. A special embodiment of the second contacting device 4 for contacting three contact points is illustrated in FIG. 9.

Figure 8:
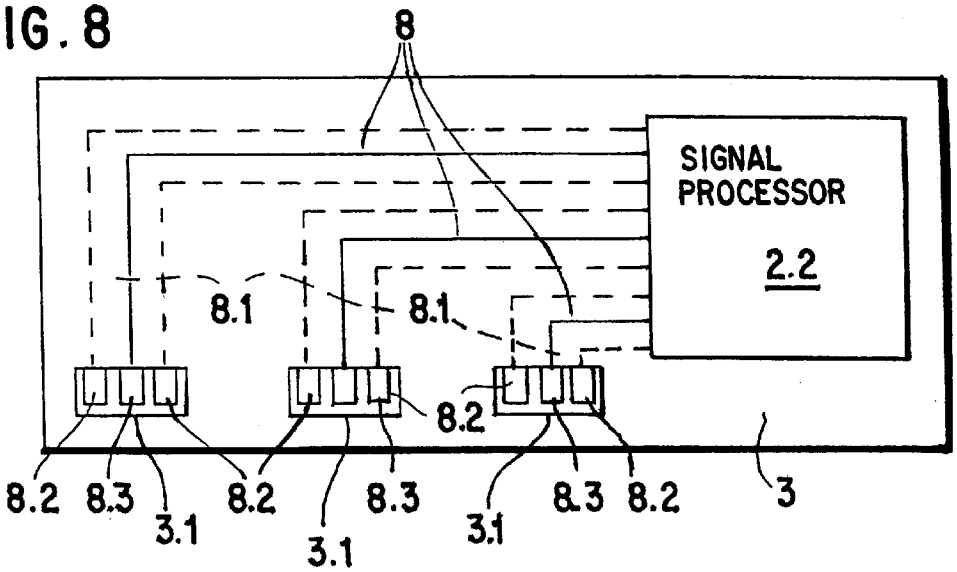
FIG. 8 is a schematic representation of an embodiment of the invention in which several electric connection lines and the electric signal processing circuit are arranged on the carrier.

FIG. 8 is a schematic view of an embodiment of the invention in which the carrier 3 is arranged within a housing, which is not shown, for an electric signal processing circuit 2.2. In the embodiment, three electric connection lines are shown with the corresponding contact bases 3.1 for the electric connection of three antenna conductor structures (not shown) with the corresponding electric signal processing circuits. The electric connection lines are constructed as strip lines with one antenna conductor 8 respectively arranged on the top side of the carrier 3 and one grounding line 8.1 arranged on the underside side of the carrier 3 according to FIG. 7*a* and FIG. 7*b*. In addition, these areas of the carrier 3 are called contact bases 3.1 on which the grounding contacts 8.2 and the antenna conductor contacts 8.3 of the pertaining electric connection line are arranged. It is also possible for the whole underside of the carrier 3 to be constructed as a grounding conductor 8.1 which, by means of throughplatings in the area of the contact bases 3.1 is connected in an electrically conductive manner with the necessary grounding contacts 8.2 on the top side of the contact bases 3.1. However, in principle, the electric connection lines can also be constructed as coplanar lines according to FIG. 7*c* and FIG. 7*d*. The signal processing circuits which are required for the different antenna conductor structures are combined to form a signal processing circuit 2.2. In addition, the electric signal processing circuit 2.2 is also arranged on the carrier 3. In this embodiment, several breakthrough openings are provided in the housing, which is not shown, of the electric signal processing circuit. Through the several breakthrough openings, the second contacting devices on the assigned contact bases 3.1 are connected in an electrically conductive manner during the installation by means of the pertaining spring elements with the corresponding first contacting devices on the vehicle installation part. A particularly suitable spring element for this embodiment is illustrated in FIG. 9.

Figure 9:
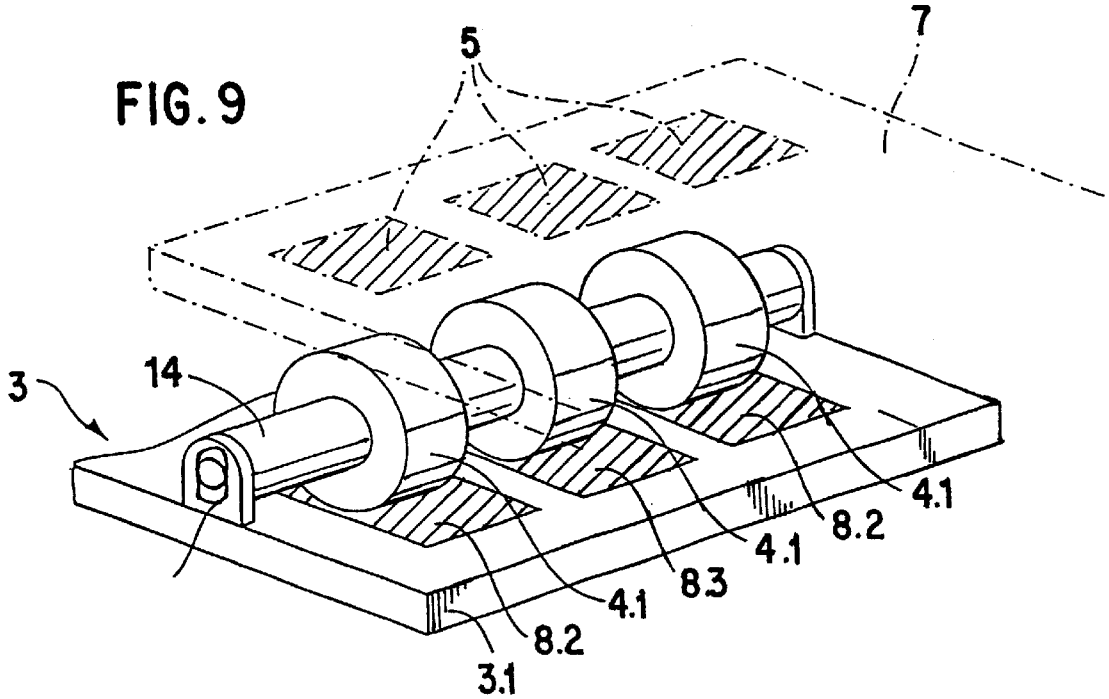
FIG. 9 is a schematic representation of a special embodiment of the spring element for contacting several antenna conductor structures.

FIG. 9 shows an embodiment of the invention for simultaneously contacting several second contacting devices by means of the corresponding first contacting devices 5. In this case, a second contacting device 4 consists of a spring element 4.1 and of a contact surface. The contact surface can be constructed as a grounding contact 8.2 or as an antenna conductor contact 8.3. The spring elements 4.1 for the individual contacts are arranged on a non-conductive basic carrier 14 which is detachably connected via corresponding fastening devices 14.1 with the contact base 3.1. Together with the spring elements 4.1, the basic carrier 14 can take over the function of a spacing buffer for the vehicle installation part 7 shown by a broken line. In order to achieve a higher spring effect, the basic body 14 may, in addition, have a hollow construction. In this case, the spring elements 4.1 are constructed as elastomers which are electrically conductive at least on the surface. The first contacting devices 5 are constructed as contact surfaces. In this case, the electric connection line can be constructed as a strip line—that is, the grounding conductor is arranged on the underside and the antenna conductor is arranged on the top side of the carrier 3 or of the contact base 3.1—or as a coplanar line—that is, the grounding conductors 8.2 and the antenna conductor 8.3 are arranged as illustrated on the top side of the carrier 3 or contact base 3.1. The shown construction is particularly suitable for the embodiment of the invention illustrated in FIG. 8 in which several antenna conductor structures, which are not shown, must be contacted simultaneously, in which case FIG. 9 shows only the contacting of an antenna conductor structure by means of three first contacting devices on the vehicle installation part 7 shown by a broken line. By means of the lengthening of the basic carrier 14 and the application of additional spring elements 4.1, additional antenna conductor structures can be contacted simultaneously. In order to implement, for example, the embodiment according to FIG. 8, nine spring elements 4.1 must be aligned in a row at a corresponding distance on the lengthened basic carrier 14.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A contacting system for a flat antenna conductor structure integrated in a vehicle installation part, comprising:

at least one first contacting device arranged on the vehicle installation part and being connected with the antenna conductor structure integrated in the vehicle installation part;

at least one contact base, having at least one second contacting device, attached to a vehicle body, the vehicle body being different from the vehicle installation part, wherein a contacting of the first contacting device via the second contacting device takes place during a relative movement between the vehicle installation part and the contact base occurring during installation of the vehicle installation part;

at least one carrier in which said at least one contact base is an integral component thereof;

at least one signal processing circuit;

at least one electric connection line which connects the second contacting device with the signal processing circuit; and wherein for a defined impedance-adapting line routing, said at least one electric connection line is arranged in a defined manner along its entire length on said at least one carrier.

2. The contacting system according to claim 1, wherein said at least one electric connection line has a predetermined length.

3. The contacting system according to claim 1, wherein said at least one first contacting device is one of detachably and undetachably fastened on the vehicle installation part.

4. The contacting system according to claim 1, wherein at least one of said first contacting device and said second contacting device comprise a sheet metal component having a spring element.

5. The contacting system according to claim 1, wherein at least one of said first contacting device and said second contacting device is constructed as a contact surface.

6. The contacting system according to claim 1, wherein at least one of said first contacting device and said second contacting device is constructed as one of an elastomer and thermoplastic which is electrically conductive at least on a surface thereof.

7. The contacting system according to claim 1, wherein said second contacting device is fastenable in one of a detachable and fixed manner on said contact base.

8. The contacting system according to claim 1, wherein said at least one electric connection line is a coaxial cable.

9. The contacting system according to claim 2, wherein said at least one electric connection line is a coaxial cable.

10. The contacting system according to claim 1, wherein said at least one electric connection line is a strip line.

11. The contacting system according to claim 2, wherein said at least one electric connection line is a strip line.

12. The contacting system according to claim 10, wherein said strip line has a substrate formed by the carrier.

13. The contacting system according to claim 11, wherein said strip line has a substrate formed by the carrier.

14. The contacting system according to claim 1, wherein said carrier is adapted to a contour of a vehicle body.

15. The contacting system according to claim 1, further comprising a protective strip molded to said contact base, said protective strip forming a spacing buffer.

16. The contacting system according to claim 1, wherein said antenna conductor structure includes one or more antennas for different frequency ranges, said at least one first contacting device and said at least one second contacting device with a corresponding signal processing circuit being assigned to each of said one or more antennas.

17. The contacting system according to claim 16, further comprising a separate housing provided for each of said signal processing circuits.

18. The contacting system according to claim 16, wherein all of said signal processing circuits are housed in a common housing.

19. The contacting system according to claim 16, wherein several of said first contacting devices are provided for at least one of said antennas, said several first contacting devices providing an alternative contacting via said second contacting device.

20. The contacting system according to claim 1, wherein several electric connection lines for a defined impedance-adapting line routing are arranged on said carrier.

21. The contacting system according to claim 1, wherein said carrier has a dimensionally stable construction.

22. The contacting system according to claim 1, wherein said carrier is arranged within a housing for an electric signal processing circuit.

23. The contacting system according to claim 22, wherein said electric signal processing circuit is arranged on said carrier.

24. The contacting system according to claim 1, wherein said carrier is constructed as a high-frequency antenna.

25. The contacting system according to claim 24, wherein said high-frequency antenna is a UHF antenna.

26. A contacting system for a flat antenna conductor structure integrated in a vehicle installation part, comprising:

at least one first contacting device arranged on the vehicle installation part and being connected with the antenna conductor structure;

at least one contact base, having at least one second contacting device, provided on a vehicle body side, wherein a contacting of the first contacting device via the second contacting device takes place during a relative movement between the vehicle installation part and the contact base occurring during installation;

at least one carrier in which said at least one contact base is an integral component thereof;

at least one signal processing circuit;

at least one electric connection line which connects the second contacting device with the signal processing circuit;

wherein for a defined impedance-adapting line routing, said at least one electric connection line is arranged in a defined manner along its entire length on said at least one carrier; and wherein said carrier is a basic carrier arranged via corresponding fastening devices on said contact base, several spring elements being arranged on said basic carrier, wherein said spring elements are constructed as elastomers which are electrically conductive at least on a surface thereof, and wherein said spring elements are constructed together with said basic carrier as spacing buffers for the vehicle installation part.

27. The contacting system according to claim 1, wherein said vehicle installation part is a vehicle window.

28. A contacting system for a flat antenna conductor structure integrated in a vehicle window, comprising;

a first contacting device arranged on the vehicle window and connected with the antenna conductor structure integrated in the vehicle window;

a contact base, having a second contacting device, connected to a vehicle body part which, in an installed position of the vehicle window, overlaps the first contacting device on the vehicle window, the vehicle body part being different from the vehicle window;

a carrier having integral therewith said contact base;

a signal processing circuit coupled to said second contacting device via an electric connection line; and wherein for a defined impedance-adapting line routing, said electric connection line is arranged in a defined manner over its entire length on said carrier.

* * * * *